US005808248A

United States Patent [19]

Aimi et al.

[11] Patent Number: 5,808,248

[45] Date of Patent: Sep. 15, 1998

[54] SWITCH

[75] Inventors: Mitsuo Aimi, Hirakata; Hiroshi Takeda, Obama, both of Japan

[73] Assignee: Matsushita Electric Industrial Co., Ltd., Osaka, Japan

[21] Appl. No.: 544,188

[22] Filed: Oct. 17, 1995

[30] Foreign Application Priority Data

Oct. 18, 1994 [JP] Japan ..... 6-251911
Sep. 7, 1995 [JP] Japan ..... 7-230510

[51] Int. Cl.[6] ..... H01H 5/18

[52] U.S. Cl. ..... 200/16 R; 200/452

[58] Field of Search ..... 200/4, 5 R, 16 R, 200/16 B, 16 C, 16 D, 402, 405, 407–410, 412, 424, 415–417, 430, 431, 433–442, 445–449, 451–454, 456, 458–469, 471, 472

[56] References Cited

U.S. PATENT DOCUMENTS

| | | | |
|---|---|---|---|
| 2,651,690 | 9/1953 | Raney | 200/67 |
| 2,688,058 | 8/1954 | Perkins | 200/67 |
| 3,321,593 | 5/1967 | Schenke | 200/67 |
| 3,497,649 | 2/1970 | Ball | 200/67 |
| 3,857,003 | 12/1974 | Nishio et al. | 200/67 DB |
| 4,835,348 | 5/1989 | Poling et al. | 200/5 EA |
| 5,082,997 | 1/1992 | Vialy | 200/452 |

FOREIGN PATENT DOCUMENTS

| | | | |
|---|---|---|---|
| B-24 09 604 | 9/1975 | Germany | H01H 15/16 |
| u-78 01 399 | 5/1978 | Germany | H01H 13/28 |
| 2-87337 | 7/1990 | Japan | H01H 15/06 |
| 4-43051 | 4/1992 | Japan | H04M 1/06 |
| 5-74269 | 3/1993 | Japan | H01H 15/06 |

*Primary Examiner*—Michael L. Gellner
*Assistant Examiner*—Michael A. Friedhofer
*Attorney, Agent, or Firm*—McDermott, Will & Emery

[57] ABSTRACT

A fixed terminal having a fixed contact and an L-shaped moving member terminal are mounted through oblong openings of a bottom plate of a switch case at each one end. A moving switch-plate having a moving contact at one end part is suspended on the other end part of the L-shaped moving member terminal with a change-over member and a U-shaped leaf spring so that the longitudinal direction of the moving switch-plate is substantially parallel to the bottom plate of the switch case, and that the other end of the moving switch-plate is moved by a slide member to operate the switch.

8 Claims, 18 Drawing Sheets

SWITCH

FIELD OF THE INVENTION AND RELATED ART STATEMENT

1. Field of the Invention

The present invention relates generally to a switch for use in an electronics apparatus, and more particularly to a switch which is suitable for mounting on a printed circuit board.

2. Description of the Related Art

A conventional switch is described with reference to FIG. 17 and FIG. 18. A fixed terminal 2 having a contact 10A and a moving member terminal 3 supporting a moving switch-plate 6 are inserted in respective openings of a switch case 1 made of electrical insulating material such as synthetic resin. An upper supporting part 3A and a lower supporting part 3B are formed on an inner wall of a recess formed in an upper portion of the moving member terminal 3 in FIG. 17. A slide member 7 made of electrical insulating material such as synthetic resin is arranged at an upper portion of the switch case 1 so as to be movable in the direction of an arrow M. The moving switch-plate 6 is engaged with a slot 7A of the slide member 7 at an upper end part 6A. A contact 10B which contacts a contact rest part 3C of the moving member terminal 3 is fixed on a lower end part 6B of the moving switch-plate 6.

In FIG. 17 and FIG. 18, an upper end part of a V-shaped leaf spring 5 is engaged with the moving switch-plate 6 at an engaging point (B), and a lower end part thereof is engaged with the lower supporting part 3B of the moving member terminal 3. An upper end part of an L-shaped change-over member 4 is engaged with the upper supporting part 3A of the moving member terminal 3 at another engaging point or fix point (C), and a lower end part thereof is engaged with the moving switch-plate 6 at another engaging point (A).

A compression coil spring 9 is provided between the switch case 1 and a flange 7B of the slide member 7 so as to keep depressing force on the flange 7B in the direction of an arrow L. The upper opening of the switch case 1 is covered by a cover 8 made of a metal plate. The switch is mounted on a printed circuit board 25 by inserting the fixed terminal 2 and the moving member terminal 3 into openings of the printed circuit board 25, and then soldering the terminals 2 and 3 to respective conductive layers on the printed circuit board 25.

Operation of the above-mentioned switch is described with reference to schematic diagrams in FIG. 18A, FIG. 18B and FIG. 18C of the moving elements of the moving switch-plate 6, leaf spring 5 and change-over member 4. FIG. 18A shows the OFF-state of the switch. When the slide member 7 is moved in the direction of arrow M by pressing a push rod 7C as shown in FIG. 17, the moving switch-plate 6 is rotated counterclockwise and the moving switch-plate 6 represented by a line connecting between the engaging points A and B is moved in the direction of arrow N and brought close to the engaging point C as shown in FIG. 18A. In FIG. 18B, the moving switch-plate 6 is on the engaging point C. The slide member 7 is further moved in the direction of arrow M, and when the moving switch-plate 6 has passed the engaging point C as shown in FIG. 18C, the moving switch-plate 6 is rapidly moved to the direction of the arrow N and the contact 10B contacts the contact 10A of the fixed terminal 2, and the switch is closed.

In the above-mentioned conventional switch, the moving switch-plate 6 is vertically arranged with respect to the surface of the printed circuit board 25. Therefore, a size between a bottom face having the fixed terminal 2 and that between moving member terminal 3 and the cover 8 is large. Thus, there is a disadvantage that a height of the switch from the surface of the printed circuit board 25 is large.

OBJECT AND SUMMARY OF THE INVENTION

In order to solve the above-mentioned disadvantage, in the present invention, the moving member terminal takes the form of an L-shaped profile, and a moving switch-plate, a leaf spring and a change-over member are horizontally arranged substantially parallel to the bottom face of a switch case.

A switch of a first mode comprises a fixed terminal having a fixed contact on one end part and a wiring part to be connected to an external circuit on the other end part, a moving member terminal made of an L-shaped member for holding a moving switch-plate having a moving contact contacting to the fixed contact having a wiring part to be connected to an external circuit at one end part of the L-shaped member, and having a first projection part at the other end part of the L-shaped member and a recess portion formed at the base portion of the first projection part, a switch case for holding the fixed terminal and the moving member terminal so that the fixed terminal is electrically insulated from the moving member terminal and the wiring parts of the fixed terminal and the moving member terminal to be connected to respective external circuits are protruded from the same wall of the switch case, a leaf spring engaged with a second supporting recess in the recess portion formed on the moving member terminal at one end part, and inserted with the first projection part of the moving member terminal in a slit formed in a central portion, a change-over member engaged at one end with a first supporting recess formed on an opposite position to the second supporting recess in the recess portion of the moving member terminal 13, a moving switch-plate having the moving contact at one end part and a slit in a central portion, arranged substantially parallel to a face of the switch case for supporting the fixed terminal and said moving member terminal so as to protrude outward the wiring parts to be connected to external circuits, engaged rotatably with the other end of the leaf spring at an end part apart from the moving contact, and engaged rotatably with the other end of the change-over member at an end part of the slit adjacent to the moving contact, and a slide member slidably arranged in the switch case and engaged with an end part of the moving switch-plate.

In a switch of a second mode, a bent part to which the first projection part contacts when the moving contact is remote from the fixed contact is formed at an end part of a slit of the leaf spring.

In a switch of a third mode, the moving switch-plate comprises hook parts at an end part of the slit adjacent to the moving contact, and the end parts of the change-over member are engaged with the hook parts.

In a switch of a fourth mode, the moving member terminal comprises a third projection part to be inserted to the slit of the change-over member on the recess portion of the moving member terminal.

In a switch of a fifth mode, two switch units each of which comprises the moving member terminal, change-over member, leaf spring and moving switch-plate are assembled in one switch case, and two switch units are engaged with the slide member so that both the switch units are operated at the same time.

According to the present invention, the moving member terminal takes the form of the L-shaped profile, and the moving switch-plate, the leaf spring and the change-over member are horizontally arranged with respect the bottom face of the switch case. Therefore, the height of the switch can be reduced.

DESCRIPTION OF THE PREFERRED EMBODIMENTS

[first embodiment]

Figure 1:
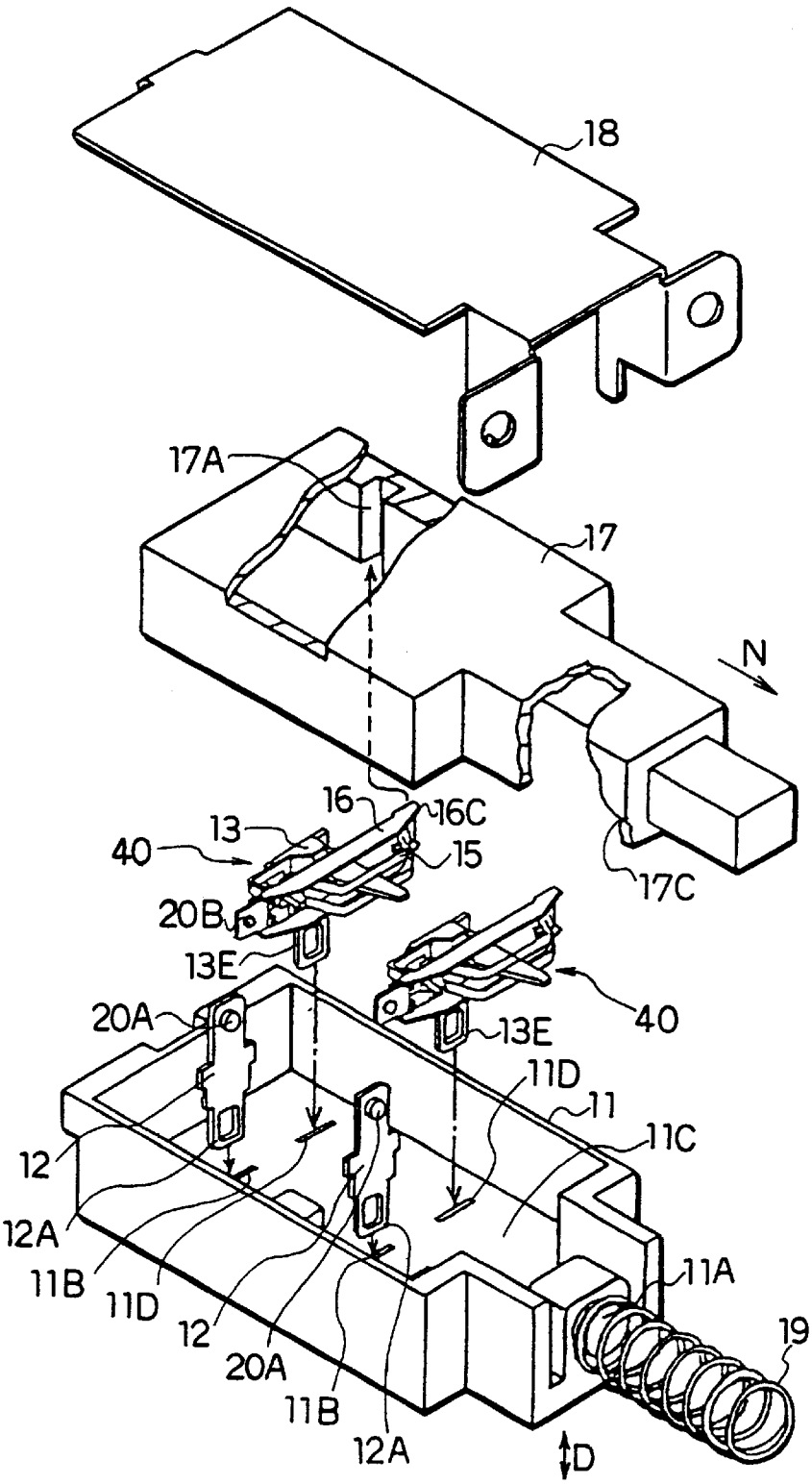
FIG. 1 is an exploded perspective assembly view of a first embodiment of the switch in accordance with the present inventions.
Figure 2A:
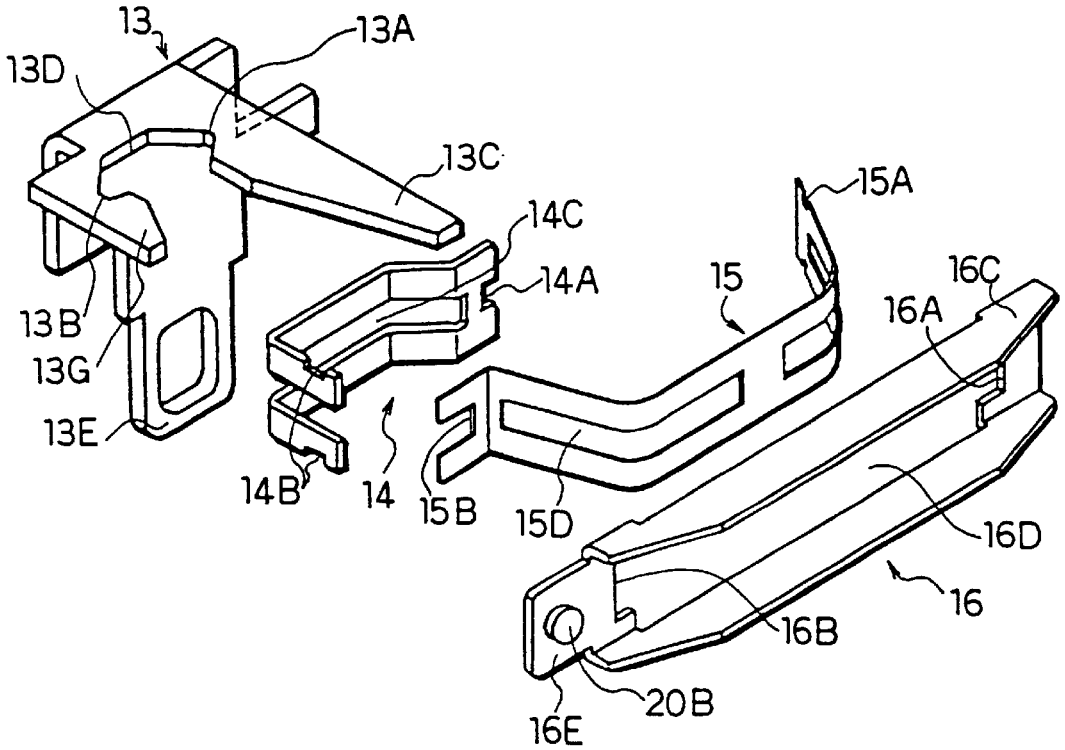
FIG. 2A is an exploded perspective assembly view of relevant parts of the first embodiment.
Figure 2B:
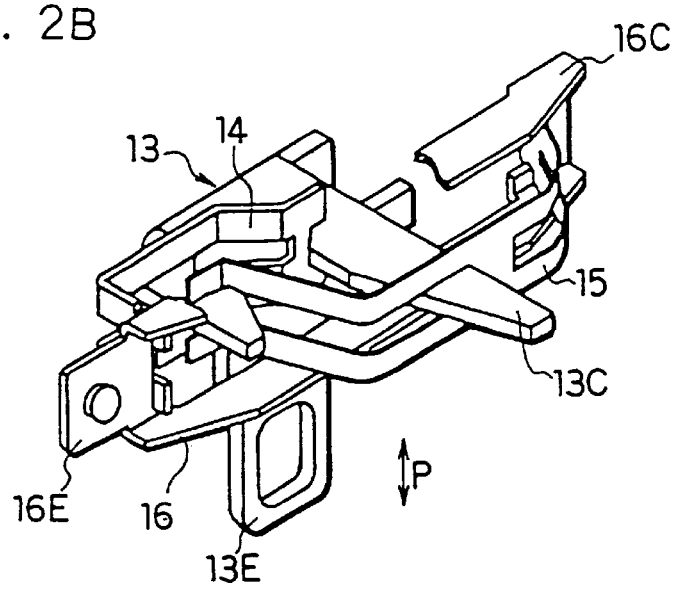
FIG. 2B is a perspective assembly view of the relevant parts in FIG. 2A.

The switch of the first embodiment in accordance with the present invention is described with reference to FIG. 1, FIG. 2A, FIG. 2B, FIG. 3A, FIG. 3B, FIG. 4A, FIG. 4B and FIG. 4C. In FIG. 1, two switch units 40 are assembled in one switch case 11, and a switch having two circuits is illustrated. The switch unit 40 is defined by an assembled mechanism as shown by FIG. 2B of which four elements as shown in FIG. 2A are assembled. The two switch units 40 are identical with each other in configuration and operation. Therefore, in the description hereafter, the description with respect to one of the switch units is applicable to the other switch unit.

Referring to FIG. 1, the switch case 11 made of electrical insulating material such as synthetic resin comprises two oblong openings 11B and two oblong openings 11D in the bottom plate 11C. A wiring part 12A of a fixed terminal 12 with a fixed contact 12A at an end part is inserted in the oblong opening 11B. The wiring part 12A is protruded outward through the oblong opening 11B of the bottom plate 11, and is connected to a conductive layer of a printed circuit board to mount the switch on the printed circuit board, for example. A wiring part 13E formed on one end part of an L-shaped moving member terminal 13 is inserted into the oblong opening 11. The wiring part 13E is also connected to an conductive layer of the printed circuit board in a manner similar to the wiring part 12A. Detailed configurations of the moving member terminal 13 and other members to be mounted on the moving member terminal 13 are shown in FIG. 2A.

A first projection part 11C and a second projection part 13G which is shorter than first projection part 13C are provided on the other end portion of the L-shaped moving member terminal 13, and a recess portion 13D is formed between the first projection part 13C and the second projection part 13G. Two recesses which serve as the first supporting recess 13A and a second supporting recess 13B respectively are formed at opposite positions on the recess portion 13D.

A recess 15B formed at one end of a shallowly U-shape bent leaf spring 15 is engaged with the second supporting recess 13B. Moreover, a recess 14A formed at one end of a change-over member 14 is engaged with the first supporting recess 13A. The change-over member 14 has a bifurcate or fork shape in which the end part having the recess 14A is a joint, and the second projection part 13G of the moving member terminal 13 is inserted in a slit 14C of the bifurcation.

The other end 15A of the leaf spring 15 is rotatably engaged with a recess 16A formed on an end part of a slit 16D of a moving switch-plate 16. Notches 14B formed on the end parts of the change-over member 14 are rotatably engaged with a cutout part 16B formed at the other end part of the slit 16D of the moving switch-plate 16. Consequently, the moving switch-plate 16 is arranged substantially parallel to the bottom plate 11C of the switch case 11. A moving contact 20B is mounted on an end part 16E of the moving switch-plate 16.

Figure 3A:
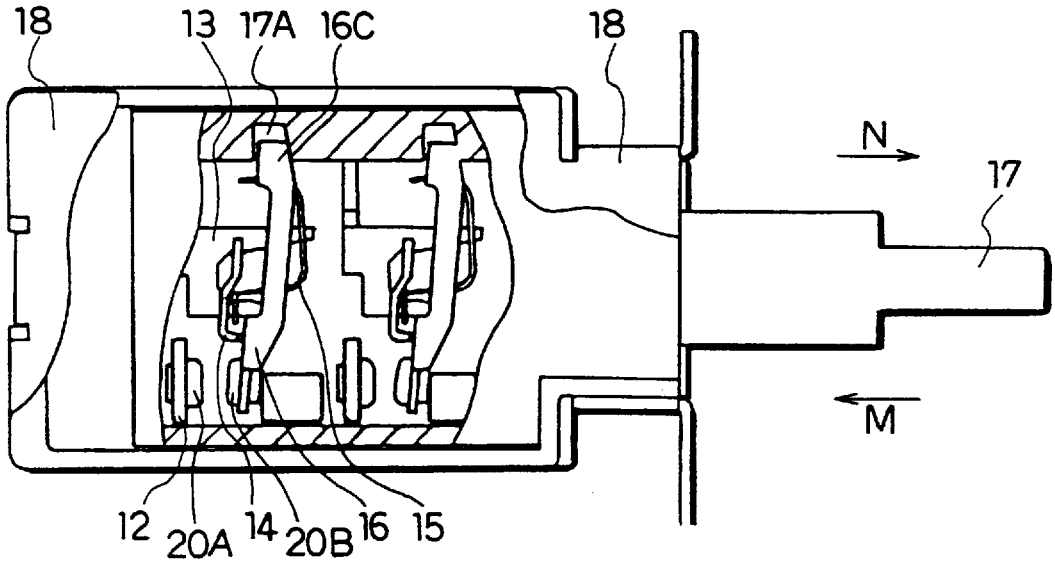
FIG. 3A is a fragmentary cross-sectional plan view of the switch, in the first embodiment.
Figure 3B:
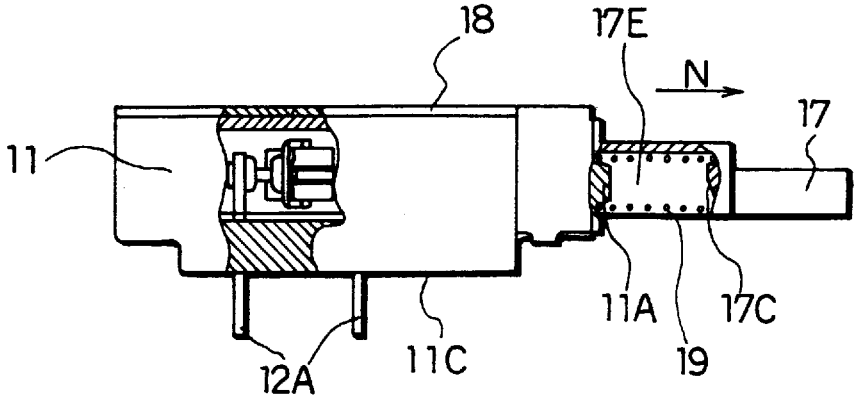
FIG. 3B is a fragmentary cross-sectional side view of the switch in the first embodiment.

Referring to FIG. 1, FIG. 3A and FIG. 3B, the slide member 17 comprises a slot 17A to be engaged with the end part 16C of the moving switch-plate 16, and can be moved in the direction of arrow M in the switch case 11. A frame 18 covers an opening part of the switch case 11 for holding the slide member 17 in the switch case 11. A coil spring 19 is arranged in interior space 17E of the slide member 17 in a compressed state, one end of the coil spring 19 is held by a spring pedestal 11A of the switch case 11 and the other end thereof is held by a spring pedestal 17C of the slide member 17 in the interior space so as to bias the slide member 17 to the direction of arrow N.

As shown in FIG. 2B, in assembled state, positional shift of the change-over member 14 and the leaf spring 15 in the direction of arrow P is prevented by engaging the recess 14A of the change-over member 14 with the first supporting recess 13A of the moving member terminal 13 and inserting the first projection part 13C of the moving member terminal 13 in a slit 15D of the leaf spring 15. The switch unit 40 is inserted in the openings 11D (FIG. 1) of the bottom plate 11C of the switch case 11 and the switch is constructed.

Operation of the switch is described hereafter. Referring to FIG. 3A, when the slide member 17 is moved by pressing in the direction of an arrow M, the end part 16C of the moving switch-plate 16 engaged with the slot 17A of the slide member 17A is moved in the direction of the arrow M; and the moving contact 20B of the moving switch-plate 16 contacts the fixed contact 20A of the fixed terminal 12 and the switch becomes ON-state.

Figure 4A:
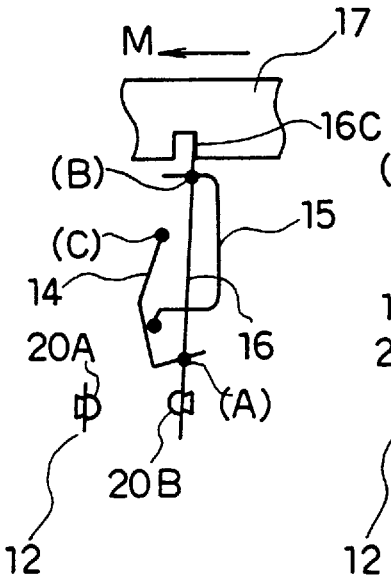
FIG. 4A, FIG. 4B, FIG. 4C are schematic diagrams representing operation of the switch of the first embodiment.
Figure 4B:
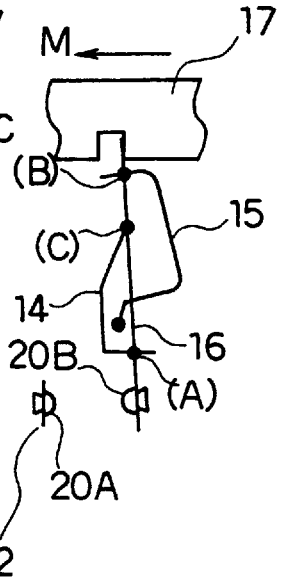
Figure 4C:
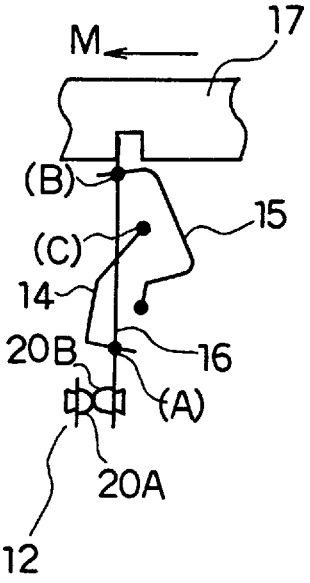

The above-mentioned operation is described in further detail with reference to FIG. 4A, FIG. 4B and FIG. 4C. FIG. 4A, FIG. 4B and FIG. 4C which schematically illustrate the change-over member 14, leaf spring 15 and moving switch-plate 16 of the switch. An engaging point (A) represents the engaging part between the notches 14B of the change-over member 14 and the cutout part 16B of the moving switch-plate 16. An engaging point (B) represents the engaging part between the other end 15A of the leaf spring 15 and the recess 16A of the moving switch-plate 16. Moreover, an engaging point (C) represents the engaging part between the recess 14A of the change-over plate 14 and the first supporting recess 13A of the moving member terminal 13. The engaging points (A) and (B) move during operation of the switch, while the engaging point (C) does not move during the operation.

FIG. 4A shows the OFF-state of the switch. When the slide member 17 is moved in the direction of arrow M, the moving switch-plate 16 represented by a straight line connecting between the engaging points (A) and (B) is moved in the direction of the arrow M by being pressed at the end part 16C by the slide member 17. The engaging point (A) is rotated clockwise about the engaging point (C). Therefore, the moving switch-plate 16 is moved so as to compress the leaf spring 15.

FIG. 4B shows the state that the moving switch-plate 16 is on the engaging point (C). In this state, the leaf spring 15 is compressed to the utmost. The slide member 17 is further moved to the direction of the arrow M, and when the moving switch-plate 16 passes the engaging point (C) as shown in FIG. 4C, the change-over member 14 is rotated clockwise by an expanding force of the leaf spring 15. Consequently, the engaging point (A) is rapidly rotated clockwise and the moving switch-plate 16 is moved in the direction of the arrow M, and the moving contact 20B contacts the fixed contact 20A of the fixed terminal 12. The slide member 17 returns to the original position by the expansion force of the coil spring 19 by releasing the slide member 17, and the switch becomes OFF-state by reverse operation to the operation as mentioned above.

As shown in FIG. 1 and FIG. 3A, two moving switch-plates 16 having the same configuration are simultaneously operated by the action of the slide member 17, and two switching circuits simultaneously becomes ON-state or OFF-state.

In the above-mentioned embodiment, when the slide member 17 is pressed in the direction of the arrow M, the switch becomes ON-state; and when the slide member 17 is released, the switch becomes OFF-state. The switch can be configurated so that it alternately becomes ON-state or OFF-state by each press of the slide member 17 by combining a known lock-mechanism (not shown). Moreover, in the case that the coil spring 19 is not mounted, the switch keeps ON-state by pressing the slide member 17, and keeps OFF-state by pulling the slide member 17.

In the present invention as mentioned above, a thin type switch of which a size between from the bottom plate 11C to the frame 18 is small is realized, since a substantially L-shaped moving member terminal 13 is mounted in the switch case 11 and the moving switch-plate 16, leaf spring 15 and change-over member 14 are arranged substantially parallel to the bottom plate 11C of the switch case 11. As shown in FIG. 1, FIG. 3A and FIG. 3B, even if two or more switching units are incorporated in the switching case 11, the size from the bottom plate 11C to the frame 18 does not increase. Therefore the thin type switch having plural switching units is realizable.

[second embodiment]

The switch of the second embodiment of the present invention is described with reference to FIG. 5A, FIG. 5B, FIG. 6 and FIG. 7. In the second embodiment, in the exploded assembly perspective view of FIG. 5A, only a moving member terminal 23 and a leaf spring 25 are different from those of in the first embodiment. Remaining elements are identical with the corresponding elements in the first embodiment. Elements similar to the elements in the first embodiment are identified by like reference numerals and the description is omitted.

Figure 5A:
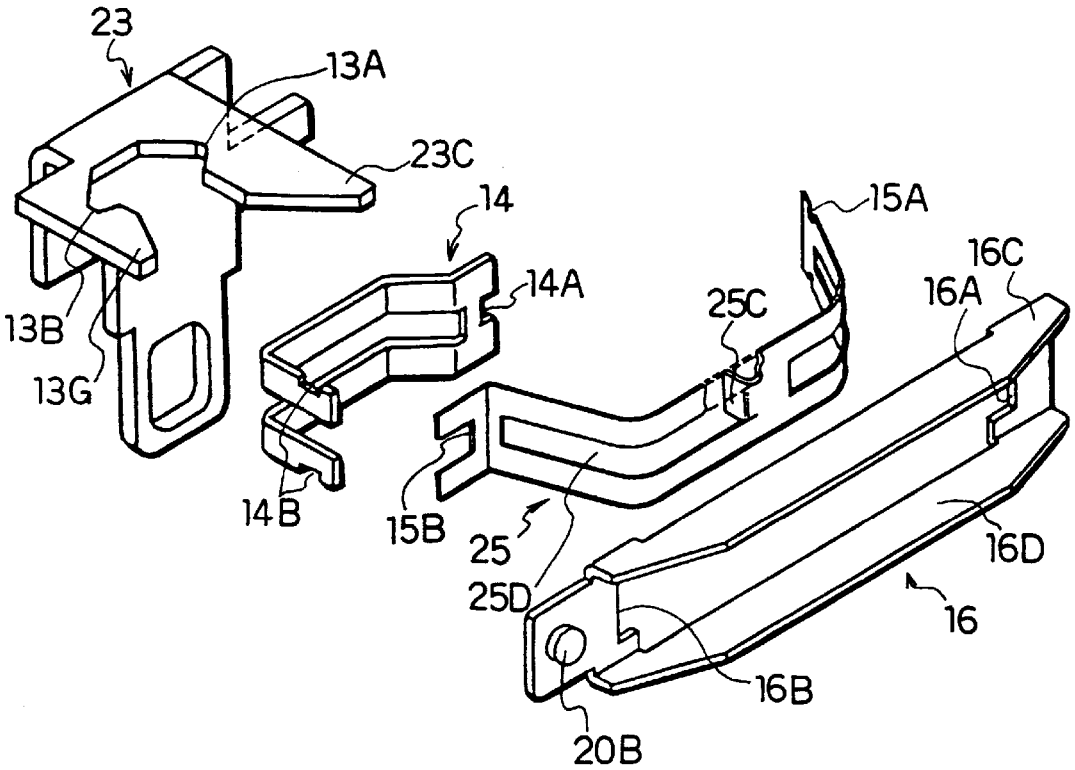
FIG. 5A is an exploded perspective assembly view of relevant parts of a second embodiment of the switch in accordance with the present invention.
Figure 5B:
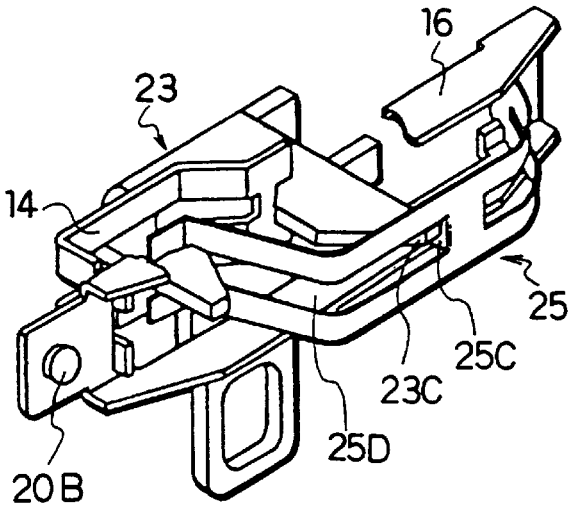
FIG. 5B is a perspective assembly view of the relevant parts of the second embodiment.

In the moving member terminal 23, a first projection part 23C of the moving member terminal 23 is made shorter than the first projection part 13C of the moving member terminal 13 as shown in FIG. 2A, and other parts are made substantially similar to the moving member terminal 13. Moreover, the leaf spring 25 has a bent part 25C at an end part apart from the recess 15B in an oblong slit 25D formed from a part: adjacent to the recess 15B to the central part of the leaf spring 25. The bent part 25C is bent to the inside of the U-shaped leaf spring 25. FIG. 5B is an assembly diagram of the switch unit in the second embodiment. Referring to FIG. 5B, the first projection part 23C of the moving member terminal 23 is inserted in the slit 25D of the leaf spring 25.

Figure 6:
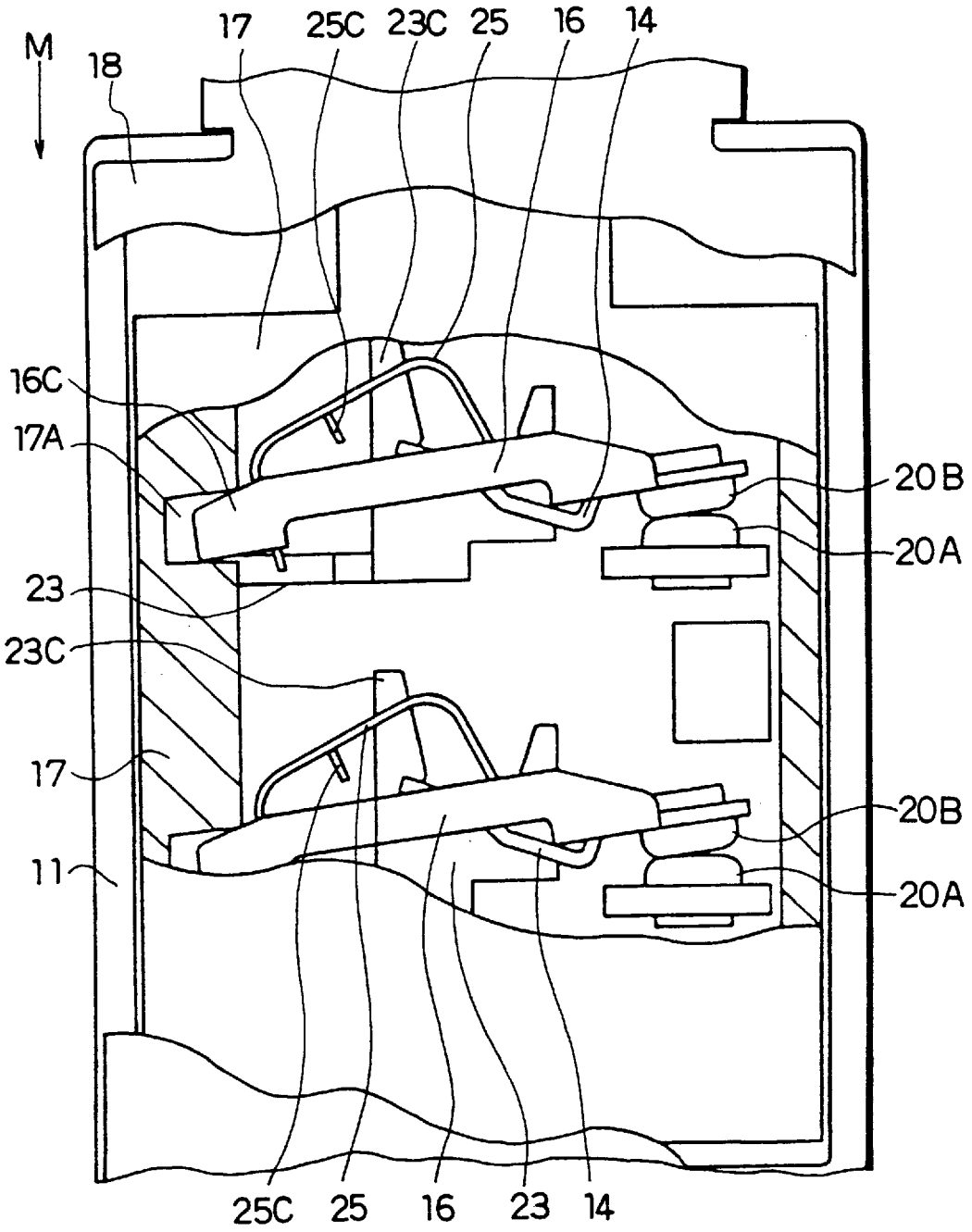
FIG. 6 is a fragmentary cross-sectional plan view of the switch of the second embodiment in ON-state.

Operation of the switch in the second embodiment is described with reference to FIG. 6 and FIG. 7. FIG. 6 is a plan view of the switch in ON-state. The slide member 17 is moved in the direction of arrow M, and the moving contact 20B of each moving switch-plate 26 contacts the fixed contact 20A. In this state, the first projection part 23C of the moving member terminal 23 is inserted in the slit 25D of the leaf spring 25.

Figure 7:
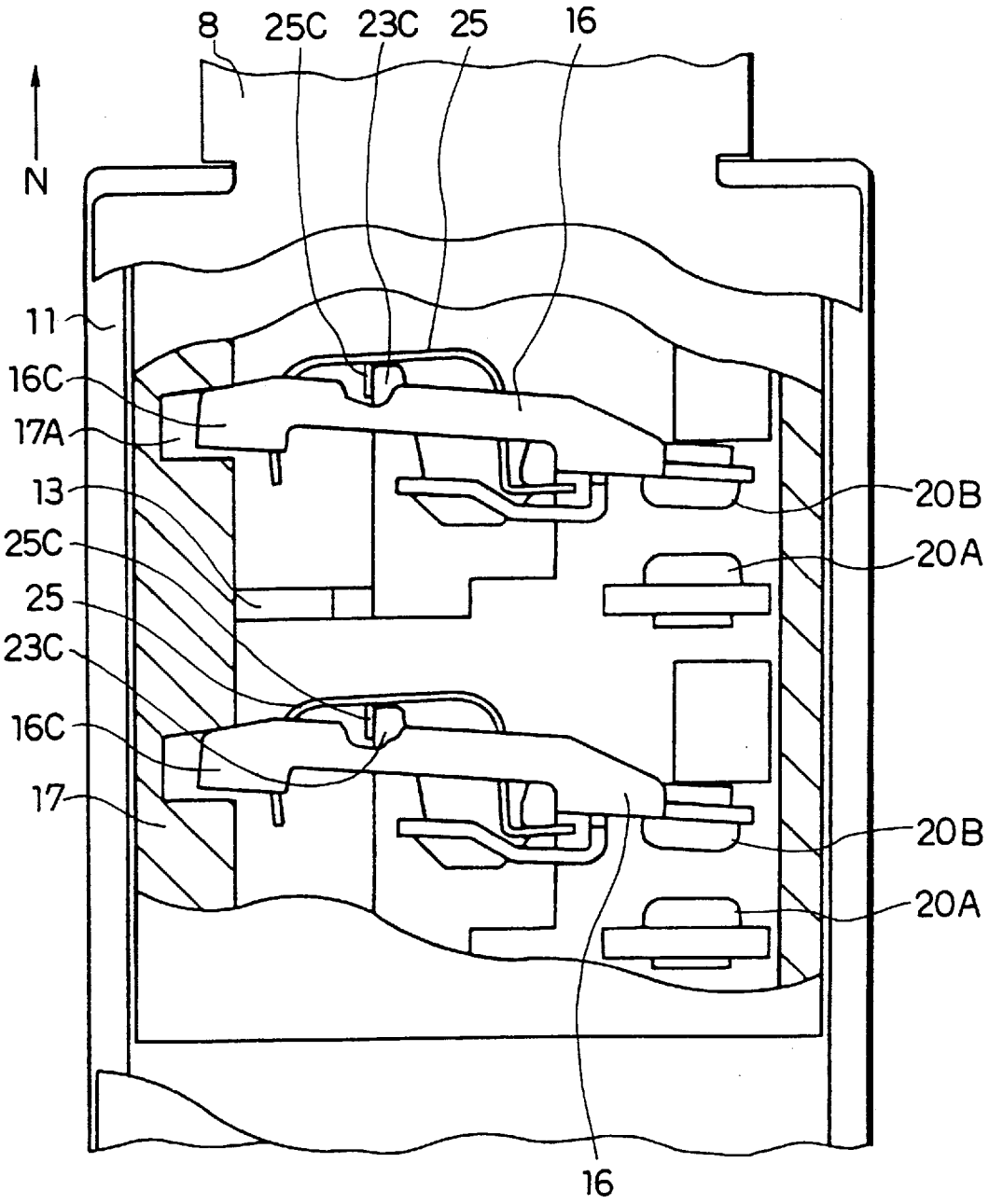
FIG. 7 is a fragmentary cross-sectional plan view of the switch in the second embodiment in OFF-state.

FIG. 7 is a plan view of the switch in which the slide member 17 is moved in the direction of arrow N and the switch is in OFF-state. The moving switch-plate 16 is moved in the direction of arrow N by the movement of the slide member 17 and the moving contact 20B is removed from the fixed contact 20A. When the moving switch-plate 16 is moved in the direction of arrow N, the leaf spring 25 rotates clockwise. Rotation of the leaf spring 25 is suspended when the bent part 25C touches the first projection part 23C of the moving member terminal 23, and movement of the moving switch-plate 16 is also suspended.

When the switch unit of the second embodiment in FIG. 5B is compared with the switch unit in the first embodiment, the first projection part 13C in FIG. 2B is longer than the first projection part 23C in FIG. 5B, and the first projection part 13C is protruded from the leaf spring 15. On the contrary, the first projection part 23C in FIG. 5B is placed at the same level of the face of the leaf spring 25. In the second embodiment, since the bent part 25C of the leaf spring 25 is protruded inside of the U-shaped leaf spring 25 and the first projection part 23C touches the bent part 25C, the first projection part 23C is not needed to be so long as to protrude from the slit 25D of the leaf spring 25. Since the first projection part 23C is shorter than the first projection part 13C, the material to fabricate the moving member terminal 23 is reduced, and the size of the switch is also reduced.

[third embodiment]

Figure 8A:
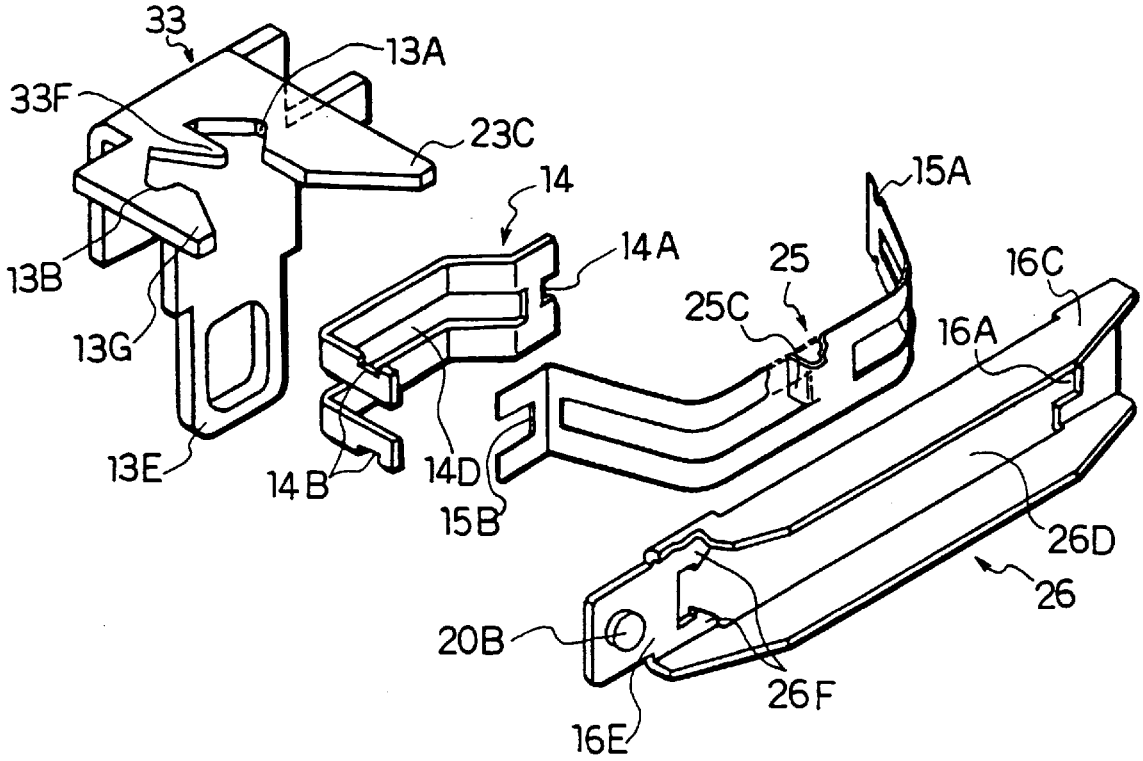
FIG. 8A is an exploded perspective assembly view of relevant parts of a third embodiment of the switch in accordance with the present invention.
Figure 8B:
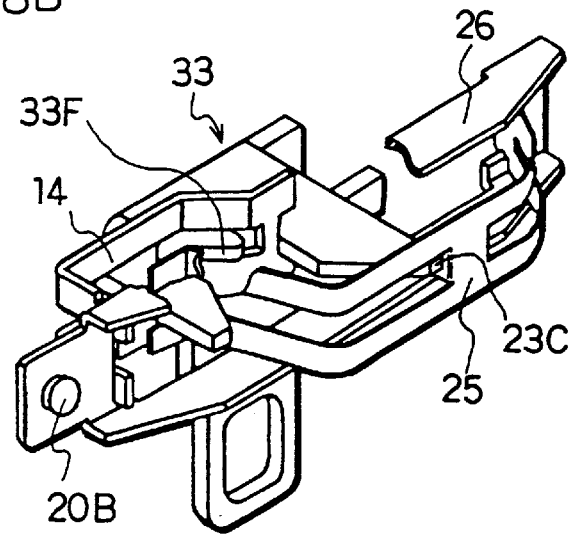
FIG. 8B is a perspective assembly view of the relevant parts of the third embodiment.

The switch of the third embodiment of the present invention is described with reference to FIG. 8A, FIG. 8B, FIG. 9A, FIG. 9B and FIG. 10. In the switch of the third embodiment, as shown in FIG. 8A and FIG. 8B, a moving member terminal 33 and a moving switch-plate 26 are different from the moving member terminal 23 and the moving switch-plate 16 in the second embodiment as shown in FIG. 5A, respectively. Other elements in the switch of the third embodiment are identical with the corresponding elements in the switch of the second embodiment. Therefore, elements similar to the elements in the second embodiment are identified like reference numerals, and the description is omitted.

In FIG. 8A, the moving member terminal comprises the first projection part 23C and the second projection part 13G which is shorter than the first projection part 23C. Furthermore, a third projection part 33F which is shorter than the second projection part 13G is provided between the first projection part 23C and the second projection part 13G.

FIG. 8B is an assembly diagram of the switch unit of the third embodiment. Referring to FIG. 8B, the third projection part 33F is inserted in the slit 14D of the change-over member 14. Position, shape and a size of the third projection part 33F are selected so as to avoid interference between motions of the third projection part 33F and the change-over member 14, leaf spring 25 and moving switch-plate 26. Referring to FIG. 8A, the moving switch-plate 26 has hook parts 26F at an end part adjacent to the moving contact 20B in a slit 26D. The hook parts 26F take the forms of hook.

Figure 9A:
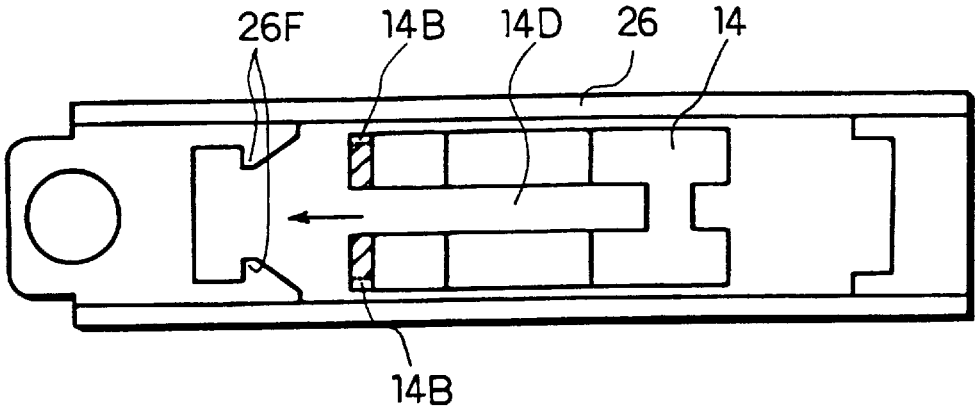
FIG. 9A is a view a moving switch-plate and a change-over member in the third embodiment.
Figure 9B:
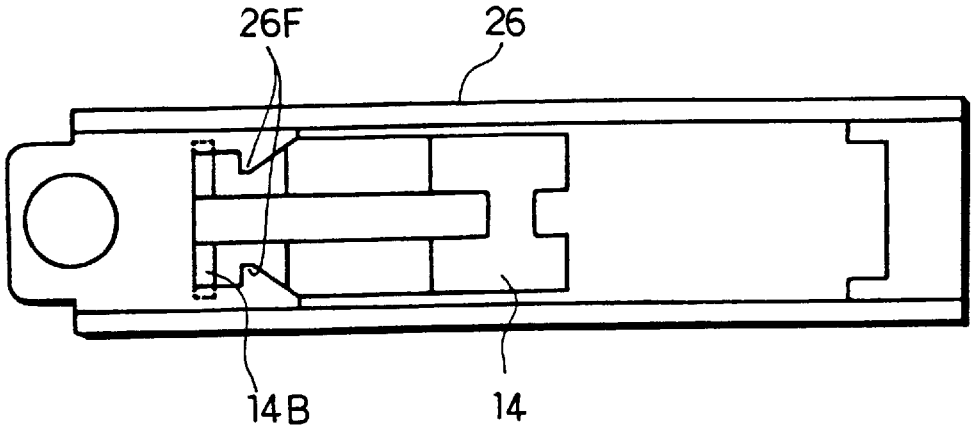
FIG. 9B is an assembly view of the moving switch-plate and the change-over member in the third embodiment.
Figure 10:
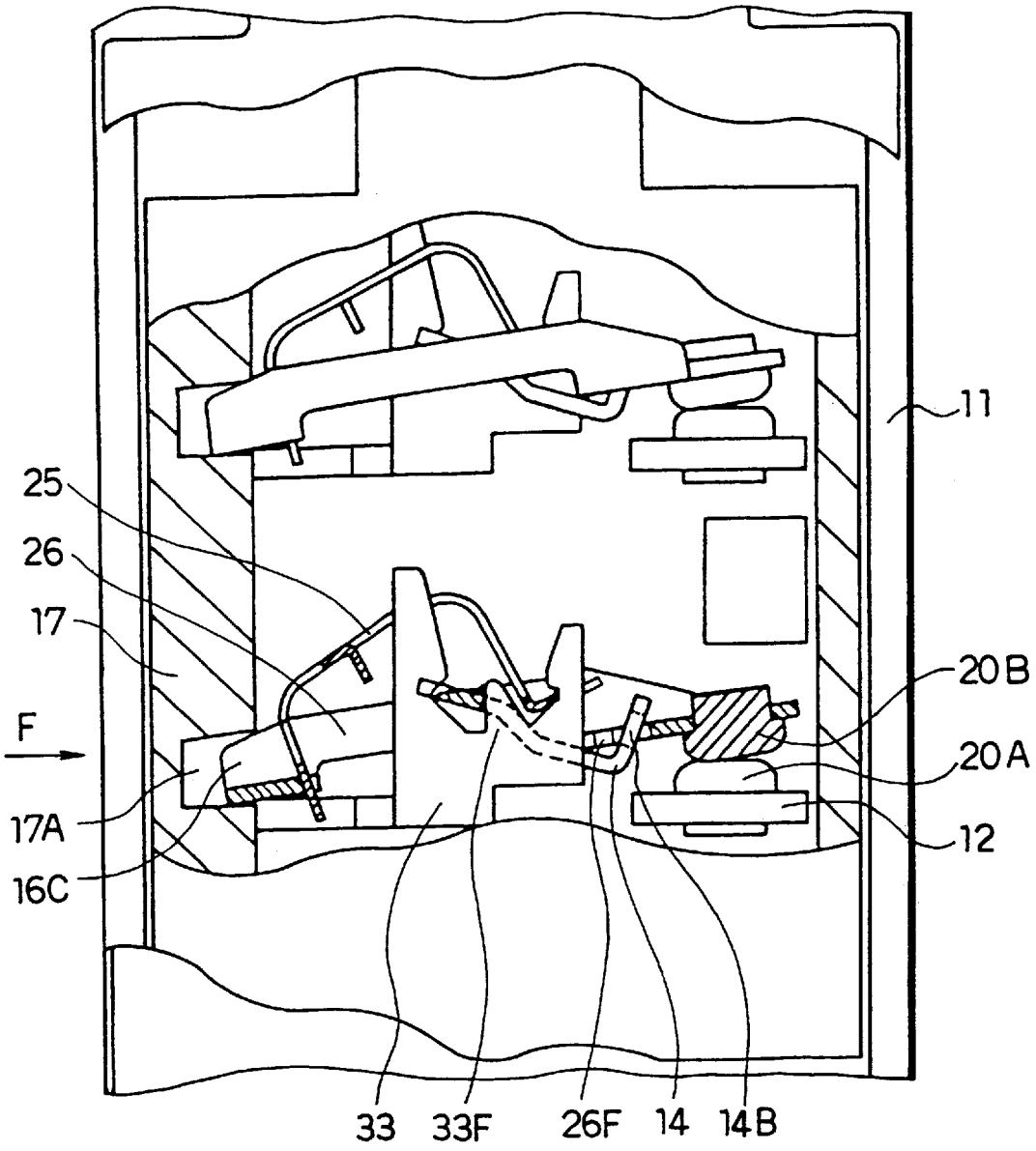
FIG. 10 is a fragmentary cross-sectional plan view of the switch in the third embodiment.

FIG. 9A is a plan view of the moving switch-plate 26 and the change-over member 14 to be engaged with the hook parts 26F of the moving switch-plate 26, at the state before the change-over member 14 is engaged with the moving switch-plate 26. In FIG. 9A, the change-over member 14 is moved in the direction of an arrow and is forced to the hook parts 26F at the notches 14B of the change-over member 14. The change-over member 14 has resiliency in the width direction, because of having the slit 14D. Therefore the notches 14B pass the arrow-shaped hook parts 26F and are engaged with the hook parts 26F as shown in FIG. 9B. Since the hook parts 26F take the forms of the hook, after the notches 14B have been inserted in the hook parts 26F, the change-over member 14 does not easily separate from the moving switch-plate 26. Namely, the change-over member 14 is temporarily assembled to the moving switch-plate 26. By the above-mentioned configuration, as shown in FIG. 10, even if a hard shock is given to the switch in the direction of arrow F in the state that the switch unit of the third embodiment is mounted in the switch case 11, the moving switch-plate 26 is not liable to separate from the change-over member 14. Moreover, the third projection part 33F is inserted in the slit 14D of the change-over member 14. When the shock is given in the direction of arrow F, the change-over member 14 is supported by the third projection part 33F. Therefore, the change-over member 14 does not shift to the direction of arrow F, and the end part 16C of the moving switch-plate 26 does not separate from the slot 17A of the slide member 17. Deformation of the leaf spring 15 due to excessive compression is prevented. Consequently, a stable and an optimum contact pressure is kept, and the switch having a high reliability and a long operating life is realizable.

Figure 11:
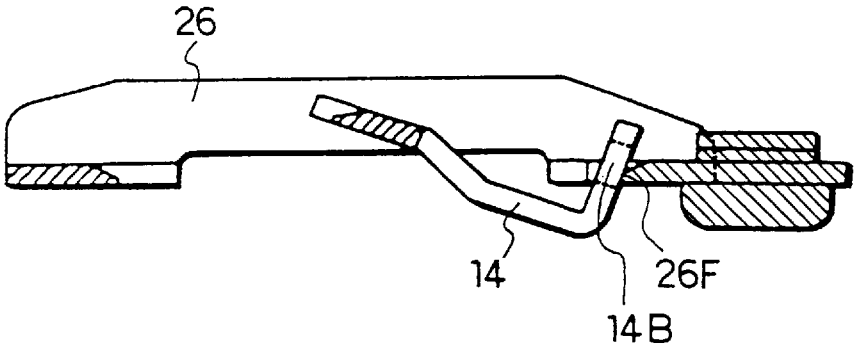
FIG. 11 is an assembly view of a moving switch-plate and a change-over member.
Figure 12:
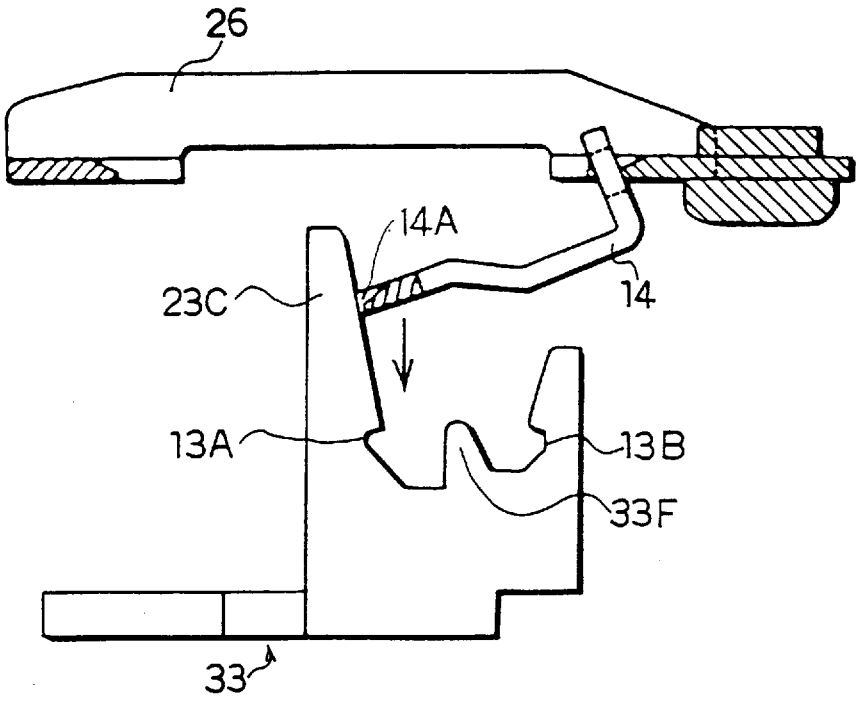
FIG. 12 is an exploded assembly view of the change-over member and a moving member terminal.
Figure 13:
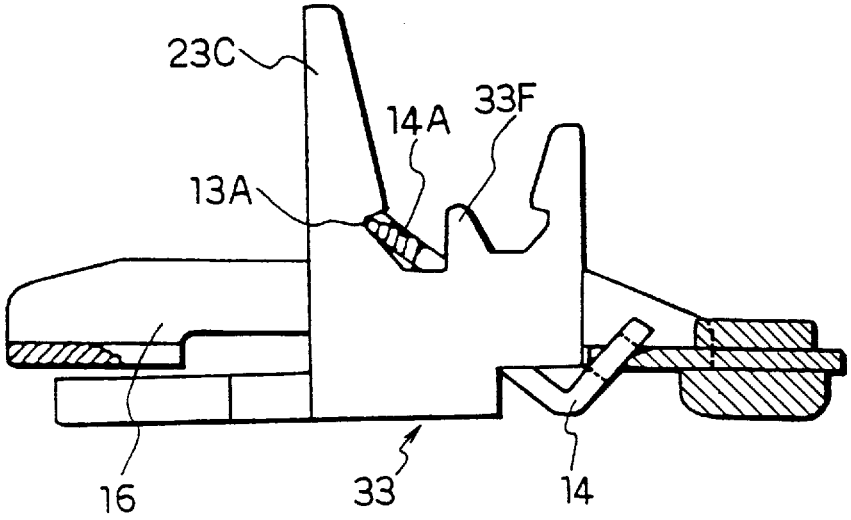
FIG. 13 is an assembly view of the moving switch-plate, the change-over member and the moving member terminal.
Figure 14:
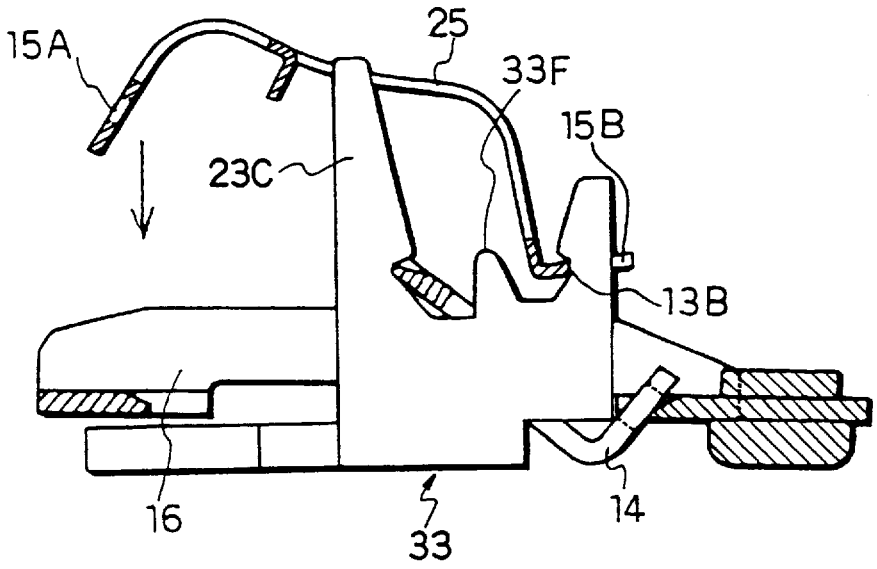
FIG. 14 is an exploded assembly view of the moving switch-plate and a leaf spring.
Figure 15:
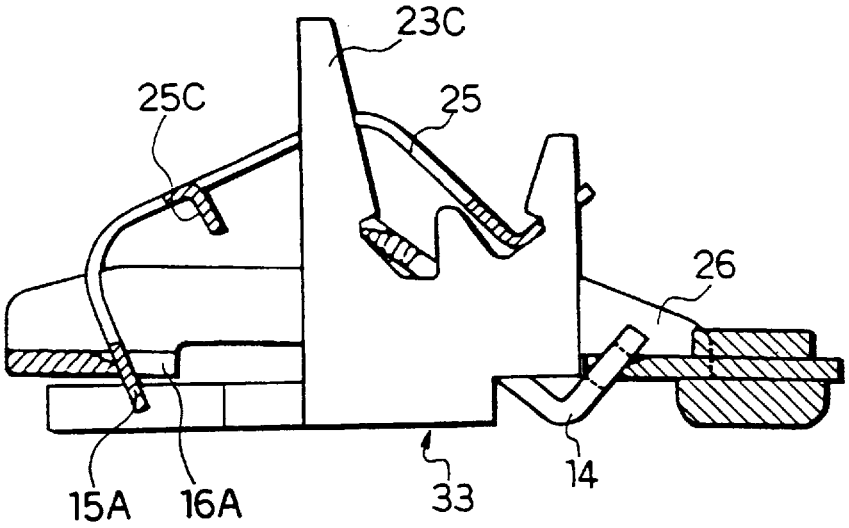
FIG. 15 is an assembly view of the moving switch-plate and the leaf spring.

Assembly process of the switch in the third embodiment is shown in FIG. 11 through FIG. 16. As shown in FIG. 11, first, the notches 14B of the change-over member 14 are inserted in the hook parts 26F of the moving switch-plate 26, and the change-over member 14 is temporarily engaged with the moving switch-plate 26. FIG. 12 shows a state before assembling with the moving member terminal 33 of the change-over member 14 which has been temporarily engaged with the moving switch-plate 26. As shown in FIG. 13, the recess 14A of the change-over member 14 is engaged with the first supporting recess 13A. Furthermore, as shown in FIG. 14, the recess 15B of the leaf spring 15 is engaged with the second supporting recess 13B of the moving member terminal 33. Lastly, as shown in FIG. 15, the other end 15A of the leaf spring 15 is engaged with the recess 16A of the moving switch-plate 26, and the assembly process is completed. As mentioned above, since the change-over member 14 and the moving switch-plate 26 are temporarily connected with the moving member terminal 33 by the hook parts 26F of the moving switch-plate 26 and the third projection part 33F, the assembly work is easily accomplished. Moreover, the assembly work is performed in the vertical direction in FIG. 12 through FIG. 15. Therefore, assembly operation is easy, and is able to be automatized.

Figure 16:
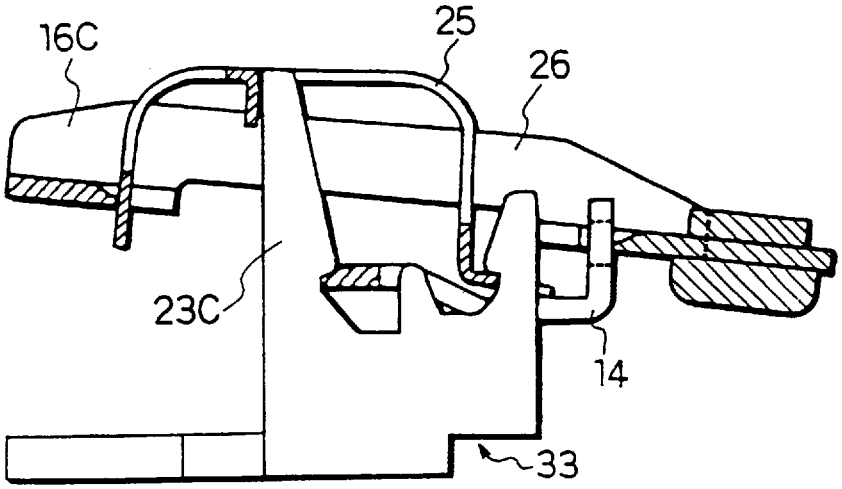
FIG. 16 is an assembly view in which the moving switch-plate is moved to mount in the switch case.
Figure 17:
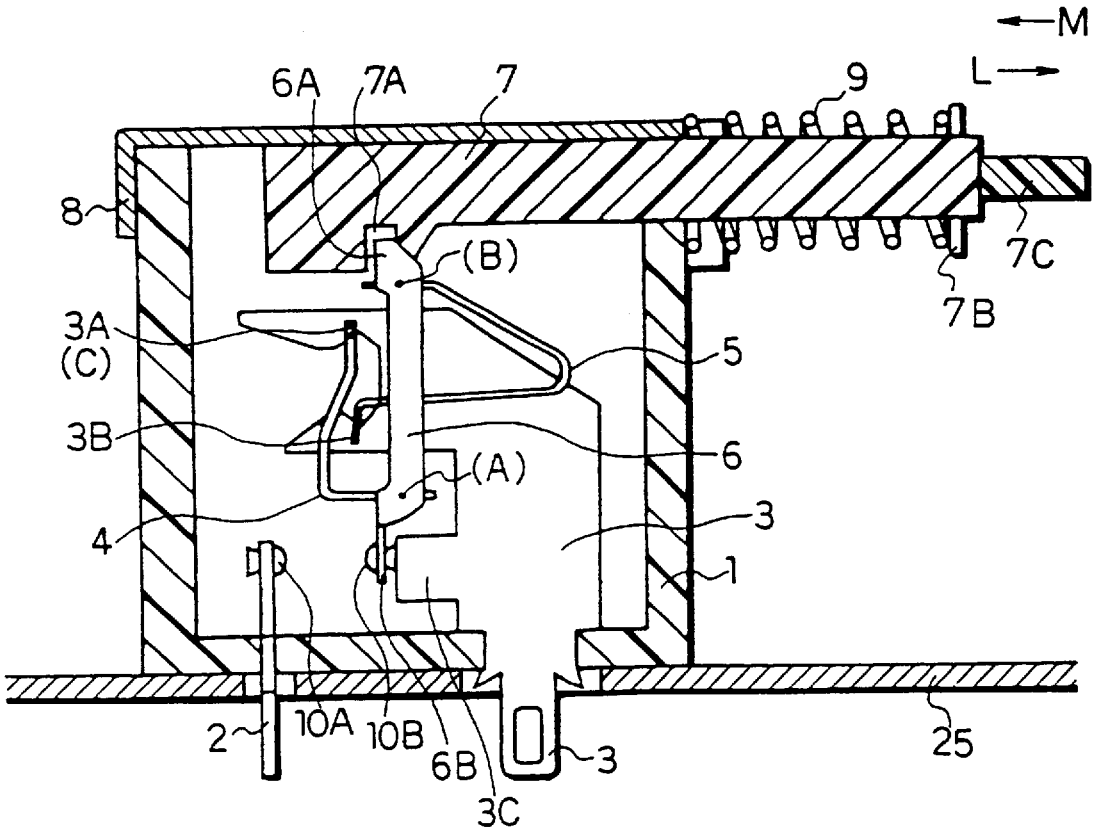
FIG. 17 ( Prior Art )
FIG. 17 is the cross-sectional side view of the switch in the prior art.
Figure 18A:
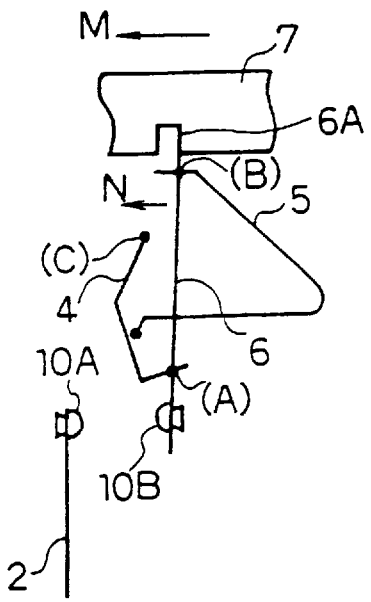
FIG.18A ( Prior Art )
FIG. 18A, FIG. 18B and FIG. 18C are schematic diagrams representing operation of the switch in the prior art.
Figure 18B:
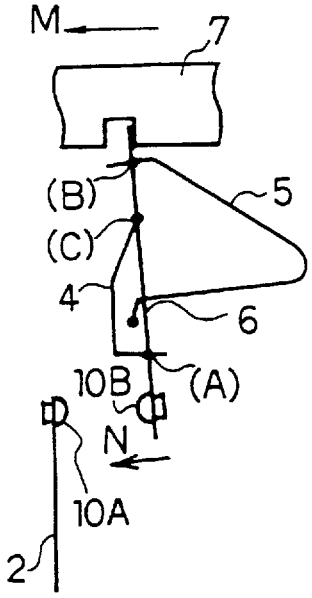
FIG.18B ( Prior Art )
Figure 18C:
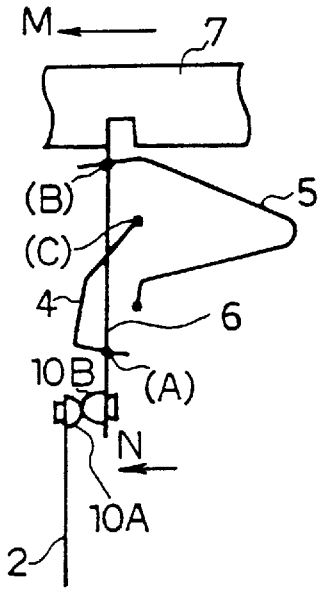
FIG.18C ( Prior Art )

Incidentally, FIG. 16 shows the switch unit in the state that the moving switch-plate 26 is in the OFF-state, and the switch unit is mounted to the switch case 11 in this state.

As mentioned above, in the switch in accordance with the present invention, the moving member terminal is formed in the L-shape, and the moving switch-plate, the leaf spring and the change-over member are arranged substantially parallel to the bottom face of the switch case. Therefore the height of the switch from the mounting printed circuit board to the frame cover can be reduced.

In the case of a switch comprising the leaf spring 25 having the bent part 25C, when the switch turns to OFF-state, the bent part 25C touches the first projection part 23C of the moving member terminal 23; and the movement of the leaf spring 25 is suspended. Therefore, the length of the first projection part can be reduced. Consequently, the material for making the moving member terminal 23 is reduced and a size of the switch is also reduced.

In the embodiment as explained with reference to FIG. 9A and FIG. 9B, the notches 14B of the change-over member 14 are engaged with the hook parts 26F formed on an end part of the slit 26D of the moving switch-plate 26 by utilizing elasticity of the change-over member 14 itself. In that embodiment, since the change-over member 14 is temporarily engaged with the moving switch-plate 26 in assembly process, dropout of the change-over member 14 can be prevented, the assembly work is easily accomplished, and steps of the assembly work can be reduced.

In the switch comprising the moving member terminal 33 having the third projection part 33F, since the change-over member 14 is supported by the third projection part 33F in the case that a hard shock is given to the switch, deviation of the change-over member 14 from the moving member terminal 33 is prevented. Furthermore, the assembly work is easily accomplished and automatic assembly is realizable.

Although the present invention has been described in terms of the presently preferred embodiments, it is to be understood that such disclosure is not to be interpreted as limiting. Various alterations and modifications will no doubt become apparent to those skilled in the art to which the present invention pertains, after having read the above disclosure. Accordingly, it is intended that the appended claims be interpreted as covering all alterations and modifications as fall within the true spirit and scope of the invention.

What is claimed is:

1. A switch comprising:

a fixed terminal having a fixed contact on one end part and a wiring part to be connected to an external circuit on another end part, a moving member terminal made of an L-shaped member for holding a moving switch-plate having a moving contact for detachably contacting said fixed contact, having a wiring part to be connected to an external circuit at one end part of said L-shaped member, and having a first projection part at another end part of said L-shaped member and a recess portion formed at a base portion of said first projection part, a switch case for holding said fixed terminal and said moving member terminal so that said fixed terminal is electrically insulated from said moving member terminal, and wherein the wiring parts of said fixed terminal and said moving member terminal to be connected to a respective external circuits are protruded from a wall of said switch case, a change-over member engaged at one end thereof with a first supporting recess formed on said recess portion of said moving member terminal, a leaf spring engaged at one end part thereof with a second supporting recess in said recess portion formed on said moving member terminal, and receiving said first projection part of said moving member terminal in a slit formed in a central portion of sid lead spring, said moving switch-plate having said moving contact at one end part thereof and a slit in a central portion, arranged substantially parallel to a face of said switch case for supporting said fixed terminal and said moving member terminal so as to protrude outward said wiring parts to be connected to external circuits, engaged rotatably with another end of said leaf spring at an end part apart from said moving contact, and engaged rotatably with end parts of said change-over member at a nearer end part of said slit to said moving contact, and a slide member slidably engaged in said switch case with another end part of said moving switch-plate, and being moved in the direction parallel to said wall of said switch case to operate said moving switch-plate.

2. A switch in accordance with claim 1, wherein a bent part to which said first projection part contacts when the moving contact is remote from the fixed contact is formed at an end part of said slit of said leaf spring.

3. A switch in accordance with claim 1, wherein said moving switch-plate comprises hook parts at said one end part of said slit adjacent to said moving contact of said moving switch-plate, and said end parts of said change-over member are engaged with said hook parts.

4. A switch in accordance with claim 1, wherein said moving member terminal comprises a third projection part to be inserted in a slit of said change-over member at said recess portion of said moving member terminal.

5. A switch in accordance with claim 1, wherein two switch units each of which comprises said fixed terminal, said moving member terminal, said leaf spring and said moving switch-plate are provided in one switch case, and said two switch units are engaged with said slide member so as to make simultaneous operation.

6. A switch in accordance with claim 2, wherein two switch units each of which comprises said fixed terminal, said moving member terminal, said leaf spring and said moving switch-plate are provided in one switch case, and said two switch units are engaged with said slide member so as to make simultaneous operation.

7. A switch in accordance with claim 3, wherein two switch units each of which comprises said fixed terminal, said moving member terminal, said leaf spring and said moving switch-plate are provided in one switch case, and said two switch units are engaged with said slide member so as to make simultaneous operation.

8. A switch in accordance with claim 4, wherein two switch units each of which comprises said fixed terminal, said moving member terminal, said leaf spring and said moving switch-plate are provided in one switch case, and said two switch units are engaged with said slide member so as to make simultaneous operation.

* * * * *

UNITED STATES PATENT AND TRADEMARK OFFICE

CERTIFICATE OF CORRECTION

PATENT NO. : 5,808,248

DATED : September 15, 1998

INVENTOR(S) : Mitsuo AIMI et al.

It is certified that error appears in the above-indentified patent and that said Letters Patent is hereby corrected as shown below:

Col. 9, line 39: Delete "sid" and insert --said--

Signed and Sealed this

Sixteenth Day of February, 1999

*Attest:*

*Attesting Officer*

*Acting Commissioner of Patents and Trademarks*